US012796747B2

(12) United States Patent
Arita et al.

(10) Patent No.: US 12,796,747 B2
(45) Date of Patent: Nov. 17, 2026

(54) SPORTS SOCKS

(71) Applicant: MIZUNO CORPORATION, Osaka (JP)

(72) Inventors: Kazuki Arita, Osaka (JP); Takahiro Kawamura, Osaka (JP); Chiharu Sugimoto, Osaka (JP); Koji Nishida, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 19/200,300

(22) Filed: May 6, 2025

(65) Prior Publication Data

US 2025/0366540 A1 Dec. 4, 2025

(30) Foreign Application Priority Data

May 31, 2024 (JP) ..... 2024-089487

(51) Int. Cl.
*A41B 11/00* (2006.01)
*A41B 11/12* (2006.01)

(52) U.S. Cl.
CPC ..... *A41B 11/008* (2013.01); *A41B 11/004* (2013.01); *A41B 11/12* (2013.01)

(58) Field of Classification Search
CPC ..... A41B 11/008; A41B 2400/80; A41B 2500/50; A41B 2500/54; A41D 2400/80
See application file for complete search history.

(56) References Cited

U.S. PATENT DOCUMENTS 4,728,538 A * 3/1988 Kaspar ..... D06M 17/06 427/288
6,708,348 B1 * 3/2004 Romay ..... H04B 1/707 2/239
6,766,536 B1 * 7/2004 Aarons ..... A41D 19/01558 2/161.3

(Continued)

FOREIGN PATENT DOCUMENTS

JP 5-23906 U 3/1993
JP 2012-153992 A 8/2012

(Continued)

OTHER PUBLICATIONS

Office Action issued in corresponding Japanese Patent Application No. 2024-089487, Mar. 19, 2026, 12 pages w/ translation.

*Primary Examiner* — Alissa L Hoey
(74) *Attorney, Agent, or Firm* — HSML P.C.

(57) ABSTRACT

The sports sock that includes a sock main body and an anti-slip portion disposed on the exterior side of the sock main body. The anti-slip portion includes first anti-slip portions disposed on the exterior side of a region covering the thenar, the hypothenar, and a portion therebetween on a sole of a forefoot of the sock main body. The first anti-slip portion includes a plurality of first inner anti-slip portions arranged in a radial fan-shaped manner such that the longitudinal direction extends inward from a starting point in a region covering the second metatarsal bone, the third metatarsal bone, and the fourth metatarsal bone, and a plurality of first outer anti-slip portions arranged in a radial fan-shaped manner such that the longitudinal direction extends outward from the starting point.

9 Claims, 10 Drawing Sheets

(56) References Cited

U.S. PATENT DOCUMENTS 7,346,935 B1 * 3/2008 Patterson ..... A41B 11/008 2/239
7,677,061 B2 * 3/2010 Mori ..... D04B 1/26 66/185
7,748,056 B2 * 7/2010 Mickle ..... A41D 13/0512 2/267
7,934,267 B2 * 5/2011 Nordstrom ..... A41B 11/005 2/69
7,996,924 B2 * 8/2011 Wright ..... A41D 31/18 2/239
8,220,077 B1 * 7/2012 Ott ..... A41B 11/008 2/409
8,336,118 B2 * 12/2012 Nordstrom ..... A41D 31/185 2/69
8,950,013 B2 * 2/2015 Bates ..... A41D 13/0002 2/115
10,575,566 B2 * 3/2020 Cain ..... A41B 11/008
11,149,380 B2 * 10/2021 Schott ..... D06C 7/00
11,272,745 B2 * 3/2022 Gazit ..... D04B 1/26
11,285,032 B2 * 3/2022 Eugene ..... A41B 11/003
11,612,190 B2 * 3/2023 Webb ..... A41D 13/0015 2/115
12,041,975 B2 * 7/2024 Blecha ..... D06M 23/04
12,349,742 B2 * 7/2025 Lee ..... A41B 11/004
2005/0066544 A1 * 3/2005 Beak ..... A43B 17/18 36/43
2005/0091729 A1 * 5/2005 Alley ..... A41D 19/01558 2/239
2005/0144703 A1 * 7/2005 Hilbert ..... A41B 11/008 2/239
2009/0162596 A1 * 6/2009 Rios ..... A63B 60/14 428/141
2012/0017354 A1 * 1/2012 Vadnais ..... A41B 11/004 2/239
2012/0090077 A1 * 4/2012 Brown ..... A41B 11/007 2/239
2013/0060182 A1 * 3/2013 Kotkamaa ..... A61F 5/019 66/178 R
2014/0223630 A1 * 8/2014 Johnson ..... A41D 13/0015 2/69
2014/0311187 A1 * 10/2014 Amarasiriwardena ..... A41B 11/00 66/178 R
2017/0311650 A1 * 11/2017 Hupperets ..... A43B 1/00
2019/0345651 A1 * 11/2019 Liang ..... A61F 13/08
2020/0397065 A1 * 12/2020 Jackson ..... A61K 31/196
2021/0106071 A1 * 4/2021 Bookoff ..... A41B 11/007
2022/0322754 A1 * 10/2022 Rruka ..... A41B 11/004
2024/0041135 A1 * 2/2024 Coffinardi ..... A41B 11/02
2025/0275593 A1 * 9/2025 Tsai ..... A41B 11/008

FOREIGN PATENT DOCUMENTS

JP 2013-128657 A 7/2013
JP 2019-002080 1/2019
JP 2021-055210 4/2021
WO 2019/172249 9/2019
WO WO-2020252533 A1 * 12/2020 ..... A41B 11/008

* cited by examiner

SPORTS SOCKS

BACKGROUND OF THE INVENTION

1. Field of the Invention

The present invention relates to sports socks, and specifically to sports socks capable of preventing a foot from shifting in a shoe during turning motion in sport.

2. Description of Related Art

Socks are typically used to protect feet or keep them warm, but the socks (or feet) may slip inside shoes, and thus, preventing this slippage has been examined. For example, JP 2019-2080A states that, in order to prevent sole slippage during exercise, e.g. running and jumping, while socks are being worn, an anti-slip member is provided on the outer surface side of the sole, specifically a thenar section is provided with a plurality of first anti-slip members with a predetermined angle or shape or a hypothenar section is provided with a plurality of first anti-slip members with a predetermined angle or shape. WO 2019/172249 states that, in order to improve instantaneous force for sideways movement or rotational motion during exercise, a plurality of anisotropic first anti-slip portions are provided on the exterior side of the forefoot of a sock main body, and a plurality of anisotropic second anti-slip portions are provided on the exterior side of the rear foot of the sock main body. JP 2021-55210A proposes anti-slip socks that each include an instep section with an instep-side anti-slip portion in which an instep-side anti-slip pattern is formed by providing a plurality of protrusions, and a sole section with a sole-side anti-slip portion in which a sole-side anti-slip pattern is formed by providing a plurality of protrusions, in order to suppress slippage of a foot in a shoe.

JP 2019-2080A, WO 2019/172249, and JP 2021-55210A are examples of related art.

SUMMARY OF THE INVENTION

However, in JP 2019-2080A, prevention of shifting of a foot in a shoe during turning motion in sport was not examined. A further reduction in shifting of a foot in a shoe during turning motion in sport is required for the socks disclosed in WO 2019/172249.

To address the aforementioned conventional problems, the present invention provides sports socks that can prevent a foot from shifting inside a shoe during turning motions in sports.

The present invention relates to a sports sock that includes: a sock main body; and an anti-slip portion disposed on the exterior side of the sock main body. The anti-slip portion includes a first anti-slip portion disposed on the exterior side of a region covering a thenar, a hypothenar, and a portion therebetween on the sole of the forefoot of the sock main body. The first anti-slip portion includes a plurality of first inner anti-slip portions arranged in a radial fan-shaped manner, with the longitudinal direction of each of the first inner anti-slip portions extending inward from a starting point in a region covering the second, third, and fourth metatarsal bones. Additionally, it includes a plurality of first outer anti-slip portions arranged in a radial fan-shaped manner, with the longitudinal direction of each of the first outer anti-slip portions extending outward from the starting point.

Wearing the socks of the present invention makes it possible to prevent a foot from shifting in a shoe during turning motion in sport.

DETAILED DESCRIPTION OF THE INVENTION

The inventors of the present invention conducted numerous studies in order to prevent a foot (sock) from shifting in a shoe during turning motion in sport. As a result, they found that it is possible to prevent a foot from shifting in a shoe during turning motion in sport by, based on the magnitude and direction of shear force and the position of the center of pressure during the motion, providing a plurality of first inner anti-slip portions and a plurality of first outer anti-slip portions arranged in a radial fan-shaped manner on predetermined portions of the forefoot of the sock such that the longitudinal direction extends in a predetermined direction.

Figure 8:
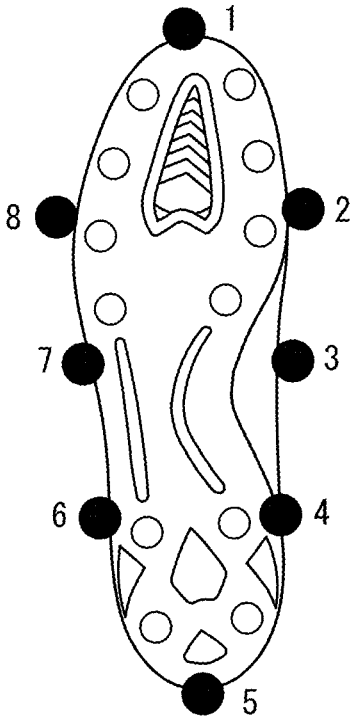
FIG. 8 is a schematic diagram showing the positions of markers attached to a spiked shoe (for a right foot) when a foot pressure is measured using a force plate.
Figure 9:
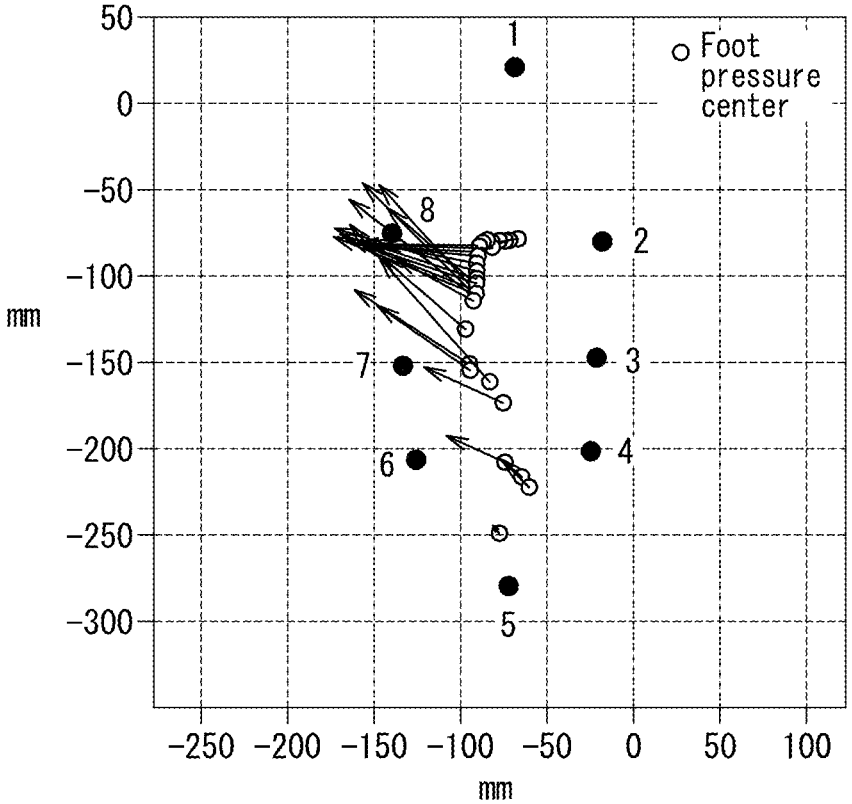
FIG. 9 is a graph showing the magnitude and direction of shear force measured as ground reaction force during 45° turning in football, and the position of the center of pressure.
Figure 10:
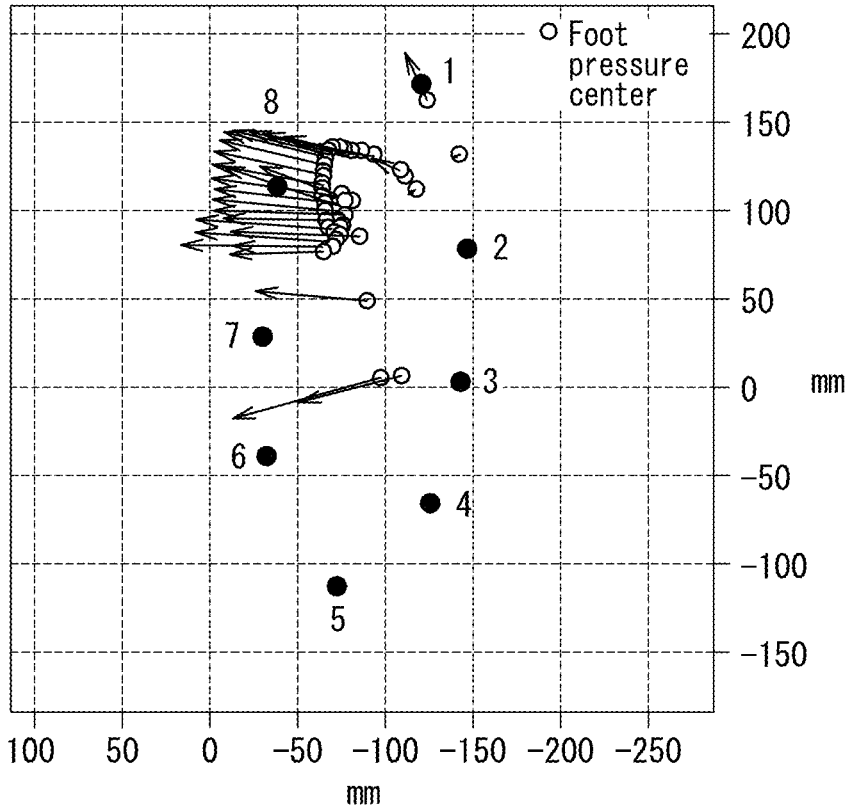
FIG. 10 is a graph showing the magnitude and direction of shear force measured as ground reaction force during 180° turning in football, and the position of the center of pressure.

The magnitude and direction of shear force, as well as the center of pressure during turning motions in sports, specifically during 45° and 180° turning motions in football, were examined. Four persons experienced in football were employed as subjects. Markers 1 to 8 were attached to predetermined positions of a spiked shoe as shown in FIG. 8, and each subject wore non-anti-slip socks and then wore the spiked shoes. Then, the magnitude and direction of shear force and the center of pressure during the motion above were measured using a force plate, and the positions of the markers 1 to 8 were measured using a motion capturing system. The results are shown in FIGS. 9 and 10. FIGS. 9 and 10 are graphs in which the center of pressure and vectors indicating the magnitude and direction of shear force were drawn every 0.01 seconds. In FIGS. 9 and 10, solid-black circles 1 to 8 indicate the markers 1 to 8 attached to the spiked shoe, respectively, the direction of an arrow indicates the direction of ground reaction force (shear force), and the length of the arrow indicates the magnitude of the ground reaction force (shear force).

As can be seen from FIGS. 9 and 10, during 45° turning motion and 180° turning motion, great force is applied to a region covering from the thenar to the hypothenar in a transverse direction (width direction) and an obliquely vertical direction, and the center of pressures concentrate in a region covering the second metatarsal bone, the third metatarsal bone, and the fourth metatarsal bone.

In one or more embodiments of the present invention, shifting of a foot inside a shoe during turning motions in sports is effectively prevented by providing a first anti-slip portion composed of a plurality of first inner and first outer anti-slip portions arranged in a radial fan-shaped manner. These portions extend inward or outward from a starting point in a region corresponding to the center of pressure during turning motions in sports, specifically 45° and 180° turning motions. The longitudinal direction of these portions extends in a transverse (width), obliquely upward, or obliquely downward direction on the exterior side of a region covering the thenar, the hypothenar, and a portion therebetween on the sole of the forefoot of the sock main body, based on the description above. If a foot slips and shifts in a shoe during turning motions in sports, quick turning becomes impossible, leading to the impairment of performance. However, wearing the sports socks of the present invention makes it possible to effectively prevent a foot from shifting in a shoe during turning motion in sport e.g. football, badminton, and tennis and suppress the impairment of performance, and particularly preferably makes it possible to effectively prevent a foot from shifting in a shoe during turning motions in football and suppress the impairment of performance.

In this specification, the outer side corresponds to the little toe side, the inner side corresponds to the big toe side, the upper portion corresponds to the toe side, the lower portion corresponds to the heel side, the interior side corresponds to the side to be in contact with the foot, and the exterior side corresponds to the side opposite to the side to be in contact with the foot.

The sports sock includes a sock main body, and an anti-slip portion disposed on the exterior side of the sock main body.

The sock main body includes a foot and a leg. The foot preferably includes a forefoot, a middle foot, and a rear foot, and the height of the leg (the length of the leg or a length from the heel) is not particularly limited. For example, the sock main body may be of a short type that has such a height that the sock main body covers the ankle, a middle type that has such a height that the sock main body reaches a portion between the ankle and the knee, or a long type that has such a height that the sock main body reaches a portion above the knee. The short type and the middle type can also be worn in combination with a calf stocking (these types are also referred to as "separate types").

In the forefoot of the sock main body, the toe may be of a normal type without separate toe sections, or it may be a two-toed type with a separate section for the big toe, or a five-toed type with five separate toe sections to facilitate bracing the foot during sports motions.

It is preferable that the sock main body is made of fiber yarn that includes elastic yarn to ensure elasticity. It is preferable that the elastic yarn includes at least one selected from polyurethane-based elastic yarn and polyester-based elastic yarn. This is because such elastic yarn has high stretchability and is suitable for socks. The elastic yarn may be used as bare yarn (naked yarn) together with nonelastic yarn (rigid yarn), or may be used as covered yarn obtained by covering the surface thereof with polyester fibers, nylon fibers, acrylic fibers, wool, cotton, or the like.

The anti-slip portion includes an anisotropic first anti-slip portion disposed on the exterior side of a region covering the thenar, the hypothenar, and a portion therebetween on the sole of the forefoot of the sock main body. In this specification, the term "anisotropy" means that the anti-slip portion does not have an isotropic shape, but has a shape with a longitudinal direction and a width direction orthogonal to the longitudinal direction. The shape of the anti-slip portion in a plan view need only be an anisotropic shape and is not particularly limited. Examples thereof include a quadrilateral shape, a pentagonal shape, a hexagonal shape, and an indefinite shape.

The first anti-slip portion includes a plurality of anisotropic first inner anti-slip portions arranged in a radial fan-shaped manner such that the longitudinal direction extends inward from the starting point in a region covering the second, third, and fourth metatarsal bones. This allows all of first ends of the plurality of anisotropic first inner anti-slip portions to be located at the starting point corresponding to the center of pressure during turning motion in sport, and also allows the longitudinal direction of each of the plurality of anisotropic first inner anti-slip portions to correspond to the direction of shear force during turning motion in sport, thus making it possible to effectively prevent a foot from being shifted in a shoe during turning motion in sport.

The number of the first inner anti-slip portions need only be more than one and is not particularly limited. It may be two or more, or three or more. The number of the first inner anti-slip portions may be two to ten, two to eight, or three to six, from the viewpoint of suppressing slippage of a foot in a shoe during turning motion in sport to effectively prevent the foot from shifting, and improving the wearing comfort.

Each of the plurality of first inner anti-slip portions may be branched into two or more branches or two to four branches at a halfway position, and each branch may be divided into two or more portions or two to six portions along the longitudinal direction. Each of the first inner anti-slip portions may have a constant width or vary in the width over the entire length. For example, in each of the plurality of first inner anti-slip portions, the width may be the smallest of the first end located at the starting point and increase as the first inner anti-slip portion extends inward.

It is preferable that the first inner anti-slip portions include one or more first inner lower anti-slip portions disposed such that the longitudinal direction extends obliquely inward and downward from the starting point, and one or more first inner upper anti-slip portions disposed such that the longitudinal direction extends obliquely inward and upward from the starting point. This arrangement more effectively suppresses slippage of the foot inside the shoe during turning motions in sports, preventing the foot from shifting. The first inner anti-slip portions may also include one or more first inner lateral anti-slip portions disposed such that the longitudinal direction extends inward from the starting point in the width direction.

The first anti-slip portion also includes a plurality of anisotropic first outer anti-slip portions arranged in a radial fan-shaped manner such that the longitudinal direction extends outward from the starting point. This allows all of first ends of the plurality of anisotropic first outer anti-slip portions to be located at the starting point corresponding to the center of pressure during turning motion in sport, and also allows the longitudinal direction of each of the plurality of anisotropic first outer anti-slip portions to correspond to the direction of shear force during turning motion in sport, thus making it possible to effectively prevent a foot from being shifted in a shoe during turning motion in sport.

The number of the first outer anti-slip portions need only be more than one and is not particularly limited. It may be two or more, or three or more. The number of the first outer anti-slip portions may be two to ten, two to eight, or three to six, from the viewpoint of suppressing slippage of a foot in a shoe during turning motion in sport to effectively prevent the foot from shifting, and improving the wearing comfort.

Each of the plurality of first outer anti-slip portions may be branched into two or more branches or two to four branches at a halfway position, and each of the branches may be divided into two or more portions or two to six portions in the longitudinal direction. Each of the plurality of first outer anti-slip portions may have a constant width or vary in the width over the entire length. For example, in each of the plurality of first outer anti-slip portions, the width may be the smallest at the first end located at the starting point and increase as the first inner anti-slip portion extends outward.

It is preferable that the first outer anti-slip portions include one or more first outer lower anti-slip portions disposed such that the longitudinal direction extends obliquely outward and downward from the starting point, and one or more first outer lateral anti-slip portions disposed such that the longitudinal direction extends outward from the starting point in the width direction. This arrangement more effectively suppresses slippage of the foot in a shoe during turning motions in sports, preventing the foot from shifting. The first outer anti-slip portions may further include one or more first outer upper anti-slip portions disposed such that the longitudinal direction extends obliquely outward and upward from the starting point.

It is preferable that, when the first inner anti-slip portion is divided into two or three sections using virtual lines at regular intervals along the longitudinal direction, the areas of the sections increase from the starting point toward the inner end side. When the first outer anti-slip portion is divided into two or three sections using virtual lines at regular intervals along the longitudinal direction, the areas of the sections increase from the starting point toward the outer end side. This makes it possible to more effectively suppress slippage of a foot in a shoe during turning motion in sport to prevent the foot from shifting.

Alternatively, it is preferable that the area of the first inner anti-slip portion in a region covering the first metatarsal bone is larger than the area of the first inner anti-slip portion in a region covering the second metatarsal bone, and the area of the first outer anti-slip portion in a region covering the fifth metatarsal bone is larger than the area of the first outer anti-slip portion in a region covering the fourth metatarsal bone. This makes it possible to more effectively suppress slippage of a foot in a shoe during turning motion in sport to prevent the foot from shifting.

Specifically, when the starting point of the first inner and first outer anti-slip portions is located in a region covering the diaphysis of the third metatarsal bone, it is preferable that the area of the first inner anti-slip portion increases in the following order: a region covering the third metatarsal bone, a region covering the second metatarsal bone, and a region covering the first metatarsal bone. Also, the area of the first outer anti-slip portion increases in the following order: a region covering the third metatarsal bone, a region covering the fourth metatarsal bone, and a region covering the fifth metatarsal bone.

It is preferable that the anti-slip portion further includes one or more anisotropic second anti-slip portions disposed at the center on the exterior side of a region covering the malleolus medialis, the malleolus lateralis, and a portion therebetween on the instep side, with the longitudinal direction of each of the second anti-slip portions extending along the foot width direction. Due to the sport sock being provided with the second anti-slip portions at positions corresponding to a shoe tongue of the sports shoe in this manner, it is possible to prevent the shoe tongue (tongue) of the sports shoe from shifting while the sport is played.

It is preferable that the anti-slip portion further includes a plurality of (e.g., two or more, or two to six) anisotropic third anti-slip portions disposed on the exterior side of the sole of the toe of the sock main body, with the longitudinal direction of each of the third anti-slip portions extending in the foot length direction. It is more preferable that the plurality of (e.g., two or more, or two to six) anisotropic third anti-slip portions are disposed at positions corresponding to the first, second, third, fourth, and fifth toes such that the longitudinal direction extends along the foot length direction. Force in the foot length direction is applied to the toe at the final stepping-out stage of acceleration during sports motion, but providing the third anti-slip portions to the toe of the sock main body such that the longitudinal direction extends in the foot length direction makes it possible to prevent a foot from slipping in a shoe at the final stepping-out stage of acceleration, thereby suppressing the impairment of performance.

It is preferable that the anti-slip portion further includes a plurality of anisotropic fourth anti-slip portions disposed on the exterior side of the sole of the rear foot of the sock main body, with the longitudinal direction of each of the fourth anti-slip portions extending in the foot length direction. The fourth anti-slip portions may include two to four long fourth central anti-slip portions disposed at the center on the exterior side of the sole of the rear foot of the sock main body, three to ten fourth left anti-slip portions disposed on the left side of the fourth central anti-slip portions, and three to ten fourth right anti-slip portions disposed on the right side of the fourth central anti-slip portions. Each of the plurality of fourth left anti-slip portions and the plurality of fourth right anti-slip portions may be divided into two or more portions in the longitudinal direction. Force in the foot length direction is applied to the heel at the initial grounding stage of stopping motion or kicking motion during sports motion, but providing the fourth anti-slip portions to the rear foot of the sock main body such that the longitudinal direction extends in the foot length direction makes it possible to prevent a foot from slipping in a shoe at the initial grounding stage of stopping motion or kicking motion, thereby suppressing the impairment of performance.

When the sock main body is of a middle type that has such a height that the sock main body reaches a portion between the ankle and the knee, it is preferable that the anti-slip portion includes a fifth anti-slip portion disposed on the exterior side above the heel, in a region extending from the heel to the upper end of the leg. With this configuration, when the sports socks of the present invention are worn as separate-type socks to be worn together with calf stockings, it is possible to suppress downward slippage of the calf stockings. It is preferable that the fifth anti-slip portion is disposed over at least half of the entire length of the leg from the viewpoint of more effectively suppressing downward slippage of the calf stockings. The fifth anti-slip portion may be disposed on the exterior side of the center in the width direction above the heel in a region extending from the heel to the upper end of the leg.

It is preferable that the anti-slip portion is made of resin. The resin is not particularly limited, and, for example, elastic resin can be used. Examples of the elastic resin include polyurethane, silicone resin, polyvinyl chloride, polyamide elastomer, polyester elastomer, rubber-based elastomer, olefin-based elastomer, polyethylene, polypropylene, nylon, EVA resin (ethylene-vinyl acetate copolymer), ABS resin (acrylonitrile-butadiene-styrene copolymer), and acrylic resin.

The anti-slip portion can be formed by, for example, applying these resin materials in a flowable state (e.g., liquid state) to the predetermined regions on the exterior side of the foot or leg of the sock main body using a printing method, followed by curing through heating.

The thickness of the anti-slip portion is not particularly limited, and may be determined as needed. For example, the first anti-slip portions, the third anti-slip portions, and the fourth anti-slip portions may have a thickness of 100 to 300 μm or 400 to 600 μm from the viewpoint of the fittedness and bare foot feeling.

When the first anti-slip portions are made of resin, it is preferable that, when the first inner anti-slip portion is divided into two or three sections using virtual lines at regular intervals along the longitudinal direction, the area of the resin in the section closest to the inner end side is larger than that in the section closest to the starting point. When the first outer anti-slip portion is divided into two or three sections using virtual lines at regular intervals along the longitudinal direction, the area of the resin in the section closest to the outer end side is larger than that in the section closest to the starting point. This makes it possible to more effectively suppress slippage of a foot in a shoe during turning motion in sport to prevent the foot from shifting.

Alternatively, when the first anti-slip portions are made of resin, it is preferable that the area of the resin in the first inner anti-slip portion in a region covering the first metatarsal bone is larger than that in a region covering the second metatarsal bone, and the area of the resin in the first outer anti-slip portion in a region covering the fifth metatarsal bone is larger than that in a region covering the fourth metatarsal bone. This makes it possible to more effectively suppress slippage of a foot in a shoe during turning motion in sport to prevent the foot from shifting.

Specifically, when the starting point of the first inner and first outer anti-slip portions is located in a region covering the diaphysis of the third metatarsal bone, it is preferable that the area of the resin in the first inner anti-slip portion increases in the following order: a region covering the third metatarsal bone, a region covering the second metatarsal bone, and a region covering the first metatarsal bone. The area of the resin in the first outer anti-slip portion increases in the following order: a region covering the third metatarsal bone, a region covering the fourth metatarsal bone, and a region covering the fifth metatarsal bone.

When the anti-slip portion is made of resin, the resin area ratio in the anti-slip portions of the first, second, third, or fourth anti-slip portions is preferably 15% to 85%, and more preferably 35% to 65%, and the resin area ratio in the anti-slip portion of the fifth anti-slip portions is preferably 10% to 70%, and more preferably 20% to 50%, from the viewpoint of suppressing the impairment of the elasticity of the sock main body and not hindering the fittedness. In this specification, the resin area ratio in the anti-slip portion refers to the ratio of the resin area to the area of the anti-slip portion in a portion where the anti-slip portion is disposed, and the area of the anti-slip portion refers to the area of a region surrounded by the outer periphery of the anti-slip portion disposed on the sock main body.

It is preferable that, in the sports socks, the sole of the middle foot of the sock main body is not provided with the anti-slip portion made of resin from the viewpoint of further improving the fittedness and the barefoot feeling.

The sports socks can be manufactured using a sock knitting machine e.g. a five-toed sock knitting machine. For example, the knitting structure of the forefoot may be smooth knitting, jersey knitting, pile knitting, or the like, the knitting structure of the middle foot may be rib knitting, rubber knitting, jersey knitting, or the like, the knitting structure of the rear foot may be smooth knitting, jersey knitting, pearl knitting, or the like, and the knitting structure of the leg may be jersey knitting, smooth knitting, rubber knitting, or the like.

Hereinafter, embodiments of the present invention will be described in detail with reference to the drawings. In the drawings, the same reference numerals denote the same components. Note that the present invention is not limited to the following embodiments shown in the drawings below. Also, in the drawings below, a sock for the left foot is described, and descriptions of a sock for the right foot are omitted because the sock for the right foot is symmetrical to the sock for the left foot.

Figure 1:
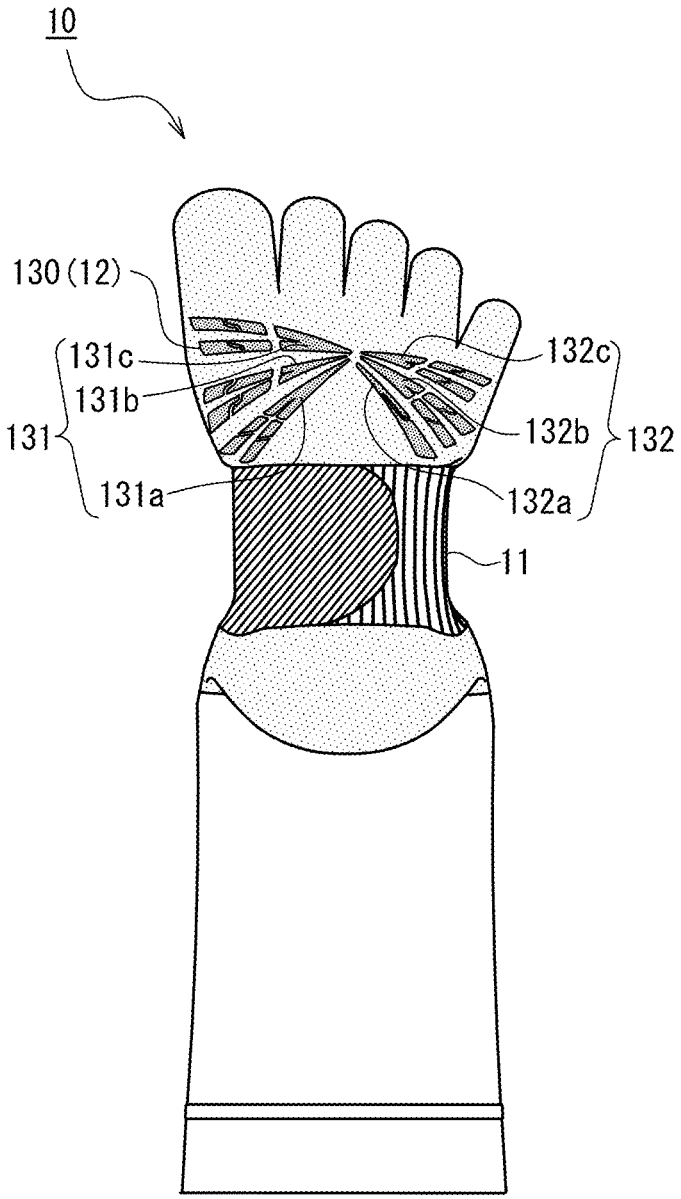
FIG. 1 is a schematic diagram showing the exterior side of a sports sock (for a left foot) according to an embodiment of the present invention that is laid out flat, as viewed from a sole side.
Figure 2:
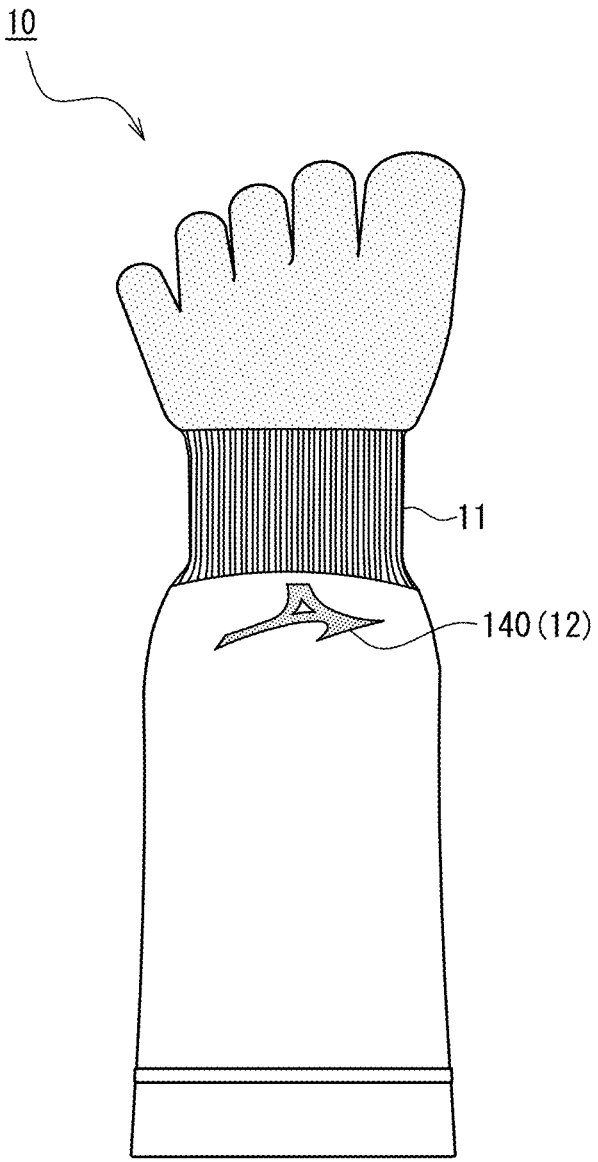
FIG. 2 is a schematic diagram showing a part of the exterior side of a sports sock (for a left foot) according to an embodiment of the present invention that is laid out flat, as viewed from an instep side.

FIG. 1 is a schematic diagram showing the exterior side of a sports sock (for a left foot) according to an embodiment (Embodiment 1) of the present invention that is laid out flat, as viewed from a sole side. FIG. 2 is a schematic diagram showing a part of the exterior side of the same sports sock (for a left foot) that is laid out flat, as viewed from an instep side.

A sports sock 10 of Embodiment 1 is of a five-toed type and includes a sock main body 11 and an anti-slip portion 12 disposed on the exterior side of the sock main body 11.

The anti-slip portion 12 includes an anisotropic first anti-slip portion 130 disposed on the exterior side of a region covering the thenar, the hypothenar, and a portion therebetween on the sole of the forefoot of the sock main body. The first anti-slip portion 130 includes three first inner anti-slip portions 131 (131*a*, 131*b*, 131*c*) arranged in a radial fan-shaped manner such that the longitudinal direction extends inward from a starting point in a region covering the second metatarsal bone, the third metatarsal bone, and the fourth metatarsal bone, and a plurality of first outer anti-slip portions 132 (132*a*, 132*b*, 132*c*) arranged in a radial fan-shaped manner such that the longitudinal direction extends outward from the starting point.

Specifically, the first inner anti-slip portions 131 include two first inner lower anti-slip portions 131*a* and 131*b* disposed such that the longitudinal direction extends obliquely inward and downward from the starting point corresponding to the diaphysis of the third metatarsal bone, and one first inner upper anti-slip portion 131*c* disposed such that the longitudinal direction extends obliquely inward and upward from the starting point.

The first inner lower anti-slip portions 131*a* and 131*b* and the first inner upper anti-slip portion 131*c* are each branched into two branches at a halfway position, and each branch is divided into three portions along the longitudinal direction. The first inner lower anti-slip portions 131*a* and 131*b* and the first inner upper anti-slip portion 131*c* do not have a constant width over the entire length. The width of each of these anti-slip portions is the smallest at a first end located at the starting point, and increases as the anti-slip portion extends inward.

Specifically, the first outer anti-slip portions 132 include two first outer lower anti-slip portions 132*a* and 132*b* disposed such that the longitudinal direction extends obliquely outward and downward from the starting point corresponding to the diaphysis of the third metatarsal bone, and one first outer lateral anti-slip portion 132*c* disposed such that the longitudinal direction extends outward from the starting point in the width direction.

The first outer lower anti-slip portion 132*b* and the first outer lateral anti-slip portion 132*c* are each branched into two branches at a halfway position, and each branch is divided into three portions along the longitudinal direction. In the first outer lateral anti-slip portion 132*c*, the lower branch is disposed so as to extend obliquely downward after being divided. The first outer lower anti-slip portion 132*a* is divided into two portions in the longitudinal direction. The first outer lower anti-slip portions 132*a* and 132*b* and the first outer lateral anti-slip portion 132*c* do not have a constant width over the entire length. The width of each of these anti-slip portions is the smallest at a first end located at the starting point, and increases as the anti-slip portion extends outward.

The anti-slip portion 12 includes one anisotropic second anti-slip portion 140 disposed at the center on the exterior side of a region covering the malleolus medialis, the malleolus lateralis, and a portion therebetween on the instep side. The longitudinal direction of the second anti-slip portion 140 extends in the foot width direction. The second anti-slip portion 140 need only have an anisotropic shape, and the shape thereof is not particularly limited.

Figure 3:
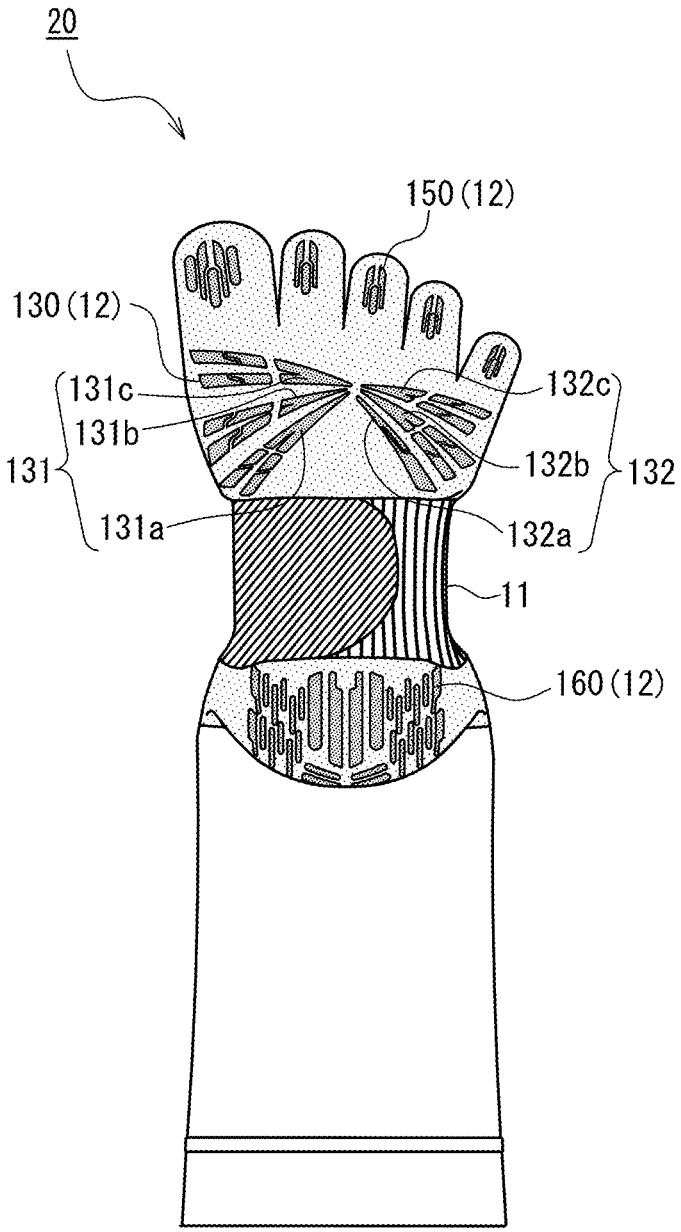
FIG. 3 is a schematic diagram showing the exterior side of a sports sock (for a left foot) according to another embodiment of the present invention that is laid out flat, as viewed from a sole side.

FIG. 3 is a schematic diagram showing the exterior side of a sports sock (for a left foot) according to another embodiment (Embodiment 2) of the present invention that is laid out flat, as viewed from a sole side.

A sports sock 20 of Embodiment 2 is of a five-toed type and includes a sock main body 11 and an anti-slip portion 12 disposed on the exterior side of the sock main body 11 similarly to the sports sock 10 of Embodiment 1. The anti-slip portion 12 includes first anti-slip portions 130 and a second anti-slip portion 140 (not illustrated). Regarding configurations identical to those in the sports sock 10 of Embodiment 1, redundant descriptions are omitted.

In the sports sock 20 of Embodiment 2, the anti-slip portion 12 further includes a plurality of anisotropic third anti-slip portions 150 disposed on the exterior side of the sole of the toe of the sock main body 11, and the longitudinal direction of each of the third anti-slip portions 150 extends in the foot length direction. More specifically, five anisotropic third anti-slip portions 150 are disposed at a position corresponding to the first toe, and three anisotropic third anti-slip portions 150 are disposed at each of positions corresponding to the second toe, the third toe, the fourth toe, and the fifth toe. The longitudinal direction of each of the third anti-slip portions 150 extends in the foot length direction.

In the sports sock 20 of Embodiment 2, the anti-slip portion 12 further includes a plurality of anisotropic fourth anti-slip portions 160 disposed on the exterior side of the sole of the rear foot of the sock main body 11, and the longitudinal direction of each of the fourth anti-slip portions 160 extends in the foot length direction. More specifically, the fourth anti-slip portions 160 include four long fourth central anti-slip portions disposed at the center on the exterior side of the sole of the rear foot of the sock main body 11, six fourth left anti-slip portions disposed on the left side of the fourth central anti-slip portions, and six fourth right anti-slip portions disposed on the right side of the fourth central anti-slip portions. Each of the six fourth left anti-slip portions and the six fourth right anti-slip portions is divided into two portions in the longitudinal direction.

A schematic diagram showing the exterior side of the sports sock 20 of Embodiment 2 as viewed from an instep side may be the same as FIG. 2, and redundant descriptions are omitted.

Figure 4:
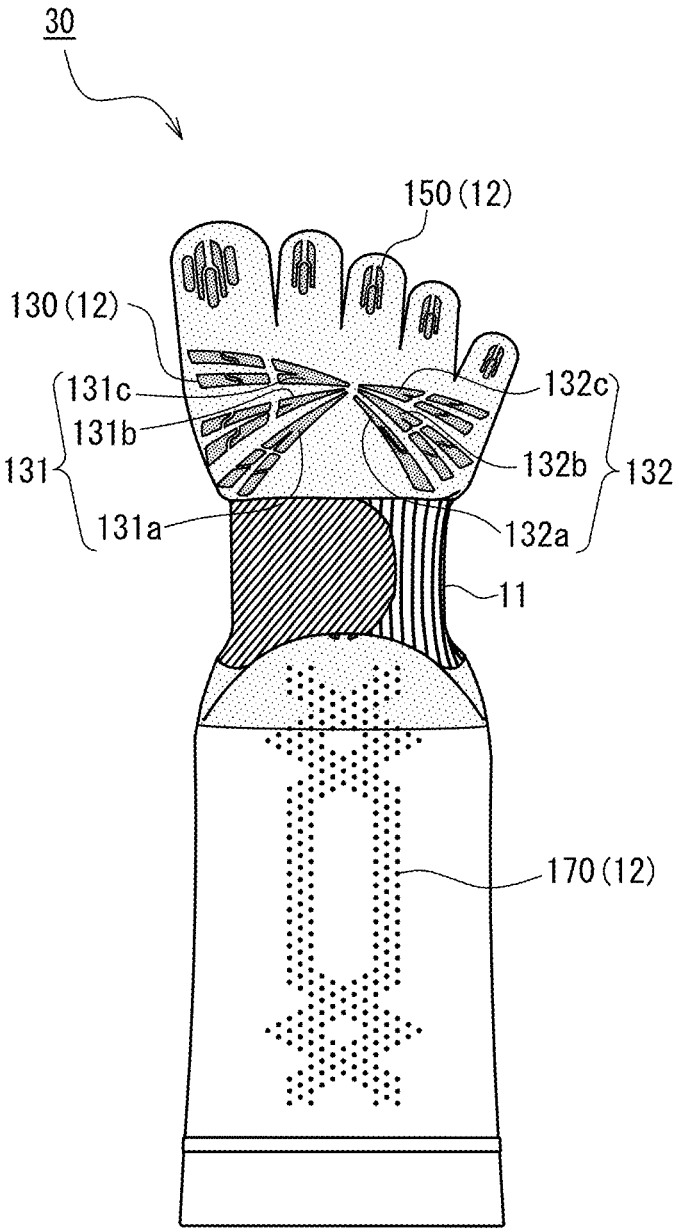
FIG. 4 is a schematic diagram showing the exterior side of a sports sock (for a left foot) according to another embodiment of the present invention that is laid out flat, as viewed from a heel side.

FIG. 4 is a schematic diagram showing the exterior side of a sports sock (for a left foot) according to another embodiment (Embodiment 3) of the present invention that is laid out flat, as viewed from a sole side (heel side). In FIG. 4, the sports sock is laid out flat such that the entire leg can be observed from the heel side.

A sports sock 30 of the Embodiment 3 is of a five-toed type and includes a sock main body 11 and an anti-slip portion 12 disposed on the exterior side of the sock main body 11 similarly to the sports sock 20 of Embodiment 2. The anti-slip portion 12 includes first anti-slip portions 130, a second anti-slip portion 140 (not illustrated), third anti-slip portions 150, and fourth anti-slip portions 160 (not illustrated). Regarding configurations identical to those in the sports sock 20 of Embodiment 2, redundant descriptions are omitted.

The sports sock 30 of Embodiment 3 has a height such that the sports sock extends to an area including an above-the ankle region and a below-the knee region. In the sports sock 30 of Embodiment 3, the anti-slip portion 12 further includes a fifth anti-slip portion 170 disposed on the exterior side of a region extending from the heel to the upper end of the leg.

A schematic diagram showing the exterior side of the sports sock 30 of Embodiment 3 as viewed from an instep side may be the same as FIG. 2, and redundant descriptions are omitted.

Figure 5:
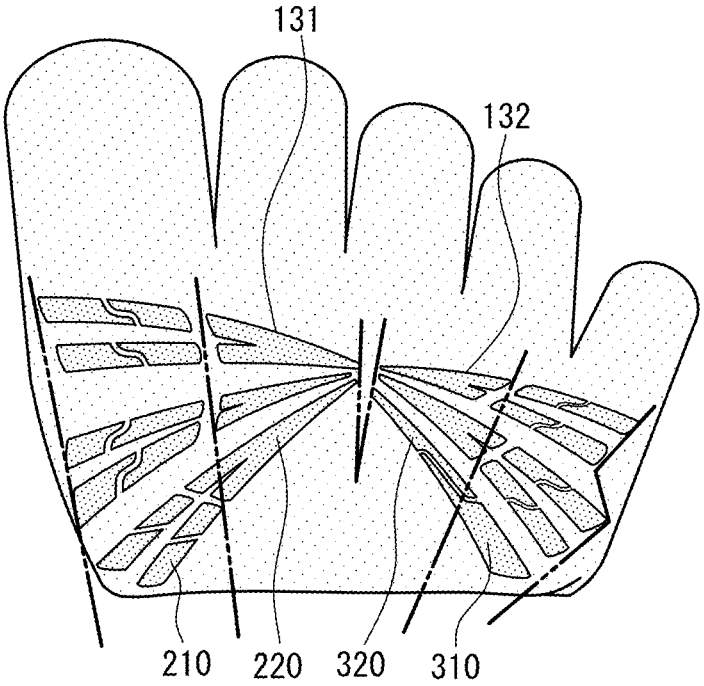
FIG. 5 is a schematic diagram showing a part of the exterior side of a sports sock (for a left foot) according to an embodiment of the present invention that is laid out flat, as viewed from a sole side.
Figure 6:
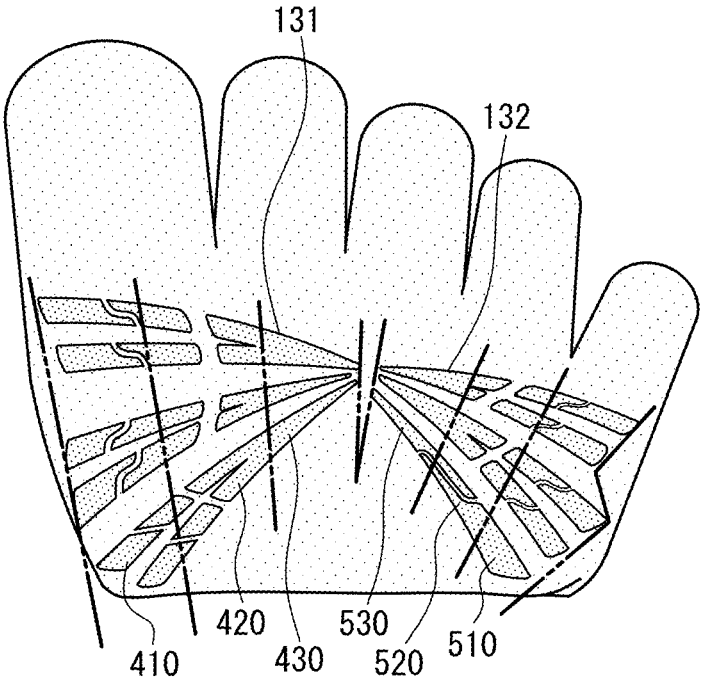
FIG. 6 is a schematic diagram showing a part of the exterior side of a sports sock (for a left foot) according to an embodiment of the present invention that is laid out flat, as viewed from a sole side.

FIGS. 5 and 6 are schematic diagrams showing a part of the exterior side of the forefoot of the sports sock according to the present invention that is laid out flat, as viewed from a sole side.

As shown in FIG. 5, when the first inner anti-slip portion 131 is divided into two sections 210 and 220 using virtual lines at regular intervals along the longitudinal direction, the area of the sections increases from section 220 to section 210, moving from the starting point toward the inner side. Specifically, the area of the section 210 located on the inner side is larger than the area of the section 220 closer to the starting point. When the first outer anti-slip portion 132 is divided into two sections 310 and 320 with virtual lines at regular intervals in the longitudinal direction, the area of the section increases in the order of the section 320 and the section 310 from the starting point toward the outer side.

Specifically, the area of the section 310 located on the outer side is larger than the area of the section 320 closer to the starting point.

As shown in FIG. 6, when the first inner anti-slip portion 131 is divided into three sections 410, 420, and 430 with virtual lines at regular intervals in the longitudinal direction, the area of the section increases in the order of the section 430, the section 420, and the section 410 from the starting point toward the inner side. Specifically, the area of the section 410 is the largest and the area of the section 430 is the smallest. When the first outer anti-slip portion 132 is divided into three sections 510, 520, and 530 with virtual lines at regular intervals in the longitudinal direction, the area of the section increases in the order of the section 530, the section 520, and the section 510 from the starting point toward the outer side. Specifically, the area of the section 510 is the largest and the area of the section 530 is the smallest.

In FIGS. 5 and 6, the first inner anti-slip portions 131 and the first outer anti-slip portions 132 are made of resin. As shown in FIGS. 5 and 6, when the first inner anti-slip portion is divided into two or three sections with virtual lines at regular intervals in the longitudinal direction, the area of the resin in the section 210 or 410 that is the closest to the inner end side is larger than the area of the resin in the section 220 or 430 that is the closest to the starting point. As shown in FIGS. 5 and 6, when the first outer anti-slip portion 132 is divided into two or three sections with virtual lines at regular intervals in the longitudinal direction, the area of the resin in the section 310 or 510 that is the closest to the outer end side is larger than the area of the resin in the section 320 or 530 that is the closest to the starting point.

As shown in FIGS. 5 and 6, the area of the first inner anti-slip portion in a region covering the first metatarsal bone is larger than that in a region covering the second metatarsal bone, and the area of the first outer anti-slip portion in a region covering the fifth metatarsal bone is larger that in a region covering the fourth metatarsal bone. Specifically, the starting point of the first inner anti-slip portions 131 and the first outer anti-slip portions 132 is located in a region covering the diaphysis of the third metatarsal bone, the area of the first inner anti-slip portion 131 increases in the order of that in a region covering the third metatarsal bone, that in a region covering the second metatarsal bone, and that in a region covering the first metatarsal bone, and the area of the first outer anti-slip portion 132 increases in the order of that in a region covering the third metatarsal bone, that in a region covering the fourth metatarsal bone, and that in a region covering the fifth metatarsal bone. This makes it possible to more effectively suppress slippage of a foot in a shoe during turning motion in sport to prevent the foot from shifting.

Specifically, the first anti-slip portions are made of resin, and the area of the resin in the first inner anti-slip portion 131 in a region covering the first metatarsal bone is larger than that in the first inner anti-slip portion 131 in a region covering the second metatarsal bone. The area of the resin in the first outer anti-slip portion 132 in a region covering the fifth metatarsal bone is larger than that in a region covering the fourth metatarsal bone.

More specifically, the starting point of the first inner anti-slip portions 131 and the first outer anti-slip portions 132 is located in a region covering the diaphysis of the third metatarsal bone, the area of the resin in the first inner anti-slip portion increases in the order of that in a region covering the third metatarsal bone, that in a region covering the second metatarsal bone, and that in a region covering the first metatarsal bone, and the area of the resin in the first outer anti-slip portion 132 increases in the order of that in a region covering the third metatarsal bone, that in a region covering the fourth metatarsal bone, and that in a region covering the fifth metatarsal bone.

Figure 7:
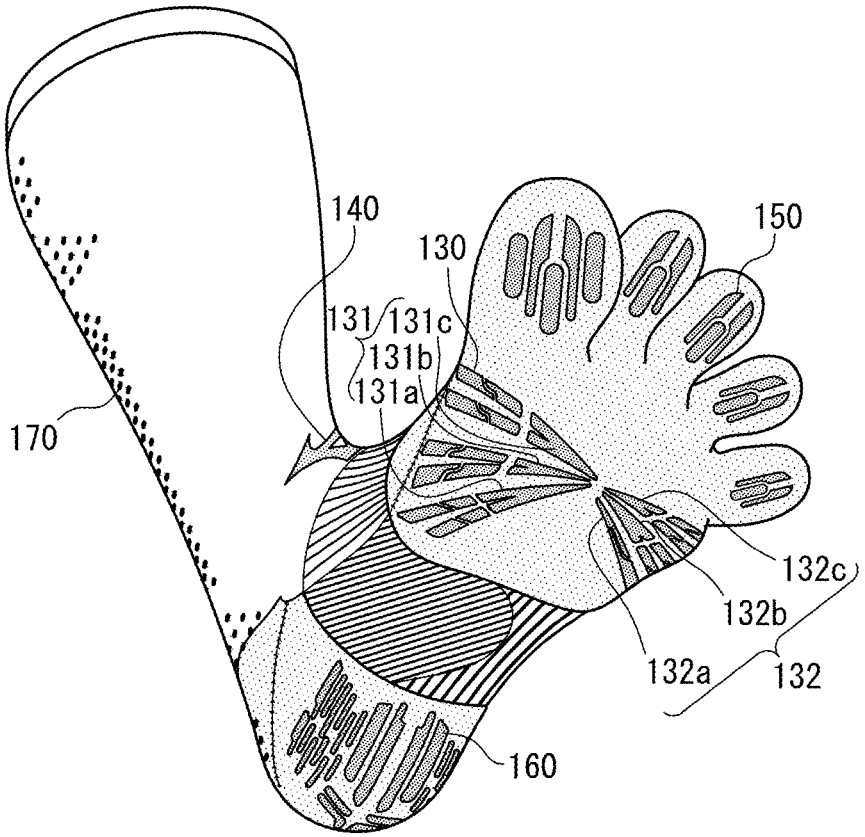
FIG. 7 is a schematic perspective view of a sports sock (for a left foot) according to an embodiment of the present invention that is worn.

FIG. 7 is a schematic perspective view of a sports sock (for the left foot) according to an embodiment (Embodiment 3) of the present invention, showing it being worn. When a person wears a sports sock 30 of Embodiment 3 and plays sport e.g. football, it is possible to effectively prevent a foot from shifting in a shoe during turning motion in sport e.g. football because the sports sock 30 includes the first anti-slip portion 130 composed of the three first inner anti-slip portions 131 (131*a*, 131*b*, and 131*c*) arranged in a radial fan-shaped manner such that the longitudinal direction extends inward from the starting point in a region covering the diaphysis of the third metatarsal bone and the three first outer anti-slip portions 132 (132*a*, 132*b*, and 132*c*) arranged in a radial fan-shaped manner such that the longitudinal direction extends outward from the starting point. Further, due to the sports sock 30 being provided with the second anti-slip portion 140, it is possible to prevent the shoe tongue (tongue) of a sports shoe e.g. a spiked shoe from shifting when sport e.g. football is played. Further, due to the sports sock 30 being provided with the third anti-slip portions 150, it is possible to prevent a foot from slipping in a shoe at the final stepping-out stage of acceleration during sport e.g. football, thereby suppressing the impairment of performance. Further, due to the sports sock 30 being provided with the fourth anti-slip portions 160, it is possible to prevent a foot from slipping in a shoe at the initial grounding stage of stopping motion or kicking motion during sport e.g. football, thereby suppressing the impairment of performance.

Further, due to the sports sock 30 being provided with the fifth anti-slip portion 170, when the sports socks 30 are worn as separate-type socks to be worn together with calf stockings (not illustrated), it is possible to suppress downward slippage of the calf stockings.

EXAMPLE

The following describes examples of the present invention, but the present invention is not limited to these examples.

Example 1

(1) Production of Sock Main Body

<Used Yarn>

The yarn used in the sock of this example was composed of three types: CALCULO™ eco (100% polyester, TEIJIN FRONTIER CO., LTD.) was used as the front thread, filament twisted yarn (FTY) (30 deniers of polyurethane and 75 deniers of polyester) was used as the under thread, and double covered yarn (DCY) (360 deniers of polyurethane and 75 deniers of polyester) was used as the elastic yarn. The entire sock was formed using the front thread and the under thread, and the middle foot and the leg were formed using the elastic yarn.

<Knitting Method>

The knitting structures of the forefoot, the middle foot, the rear foot, and the leg were smooth knitting, rubber knitting, smooth knitting, and jersey knitting, respectively, and a sock main body 11 of a five-toed type (size: for 26-cm foot, weight of one sock: 27.8 g) as shown in FIG. 4 was produced.

(2) Formation of Anti-Slip Portions

By applying silicone resin to predetermined portions on the exterior side of the sock main body 11 through printing and curing it through heating, the first anti-slip portion 130 composed of first inner anti-slip portions 131 (131*a*, 131*b*, and 131*c*) and first outer anti-slip portions 132 (132*a*, 132*b*, and 132*c*), the third anti-slip portions 150, and the fourth anti-slip portions 160 as shown in FIG. 3, the second anti-slip portion 140 as shown in FIG. 2, and the fifth anti-slip portion 170 as shown in FIG. 4 were formed, and thus the sock 30 was obtained. The first inner anti-slip portions 131 had a thickness of 400 μm, an area of 8 $cm^2$, and a resin area ratio of 50.4%. The first outer anti-slip portions 132 had a thickness of 400 μm, an area of 6.1 $cm^2$, and a resin area ratio of 52.2%. The second anti-slip portion 140 had a thickness of 200 μm, an area of 3.7 $cm^2$, and a resin area ratio of 95.3%. The third anti-slip portions 150 had a thickness of 400 μm, an area of 5.1 $cm^2$ and a resin area ratio of 64.2%. The fourth anti-slip portions 160 had a thickness of 400 μm, an area of 10.2 $cm^2$, and a resin area ratio of 50%. The fifth anti-slip portion 170 had a thickness of 400 μm, an area of 20 $cm^2$, and a resin area ratio of 35.2%.

In the sock 30, the starting point of the first inner anti-slip portions 131 and the first outer anti-slip portions 132 was located in a region covering the diaphysis of the third metatarsal bone, the area of the resin in the first inner anti-slip portion increased in the order of that in a region covering the third metatarsal bone, that in a region covering the second metatarsal bone, and that in a region covering the first metatarsal bone, and the area of the resin in the first outer anti-slip portion 132 increased in the order of that in a region covering the third metatarsal bone, that in a region covering the fourth metatarsal bone, and that in a region covering the fifth metatarsal bone.

A sock for a right foot was produced in the same manner. The sock for a right foot was symmetrical to the sock for a left foot.

Comparative Example 1

Figure 12:
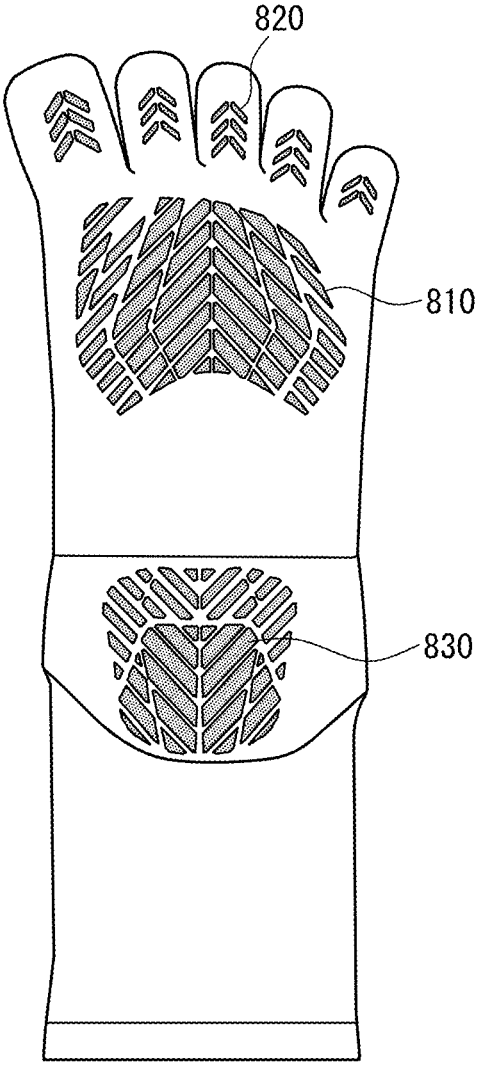
FIG. 12 is a schematic diagram showing the exterior side of a sports sock (for a left foot) used in Comparative Example 1 that is laid out flat, as viewed from a sole side.
Figure 13:
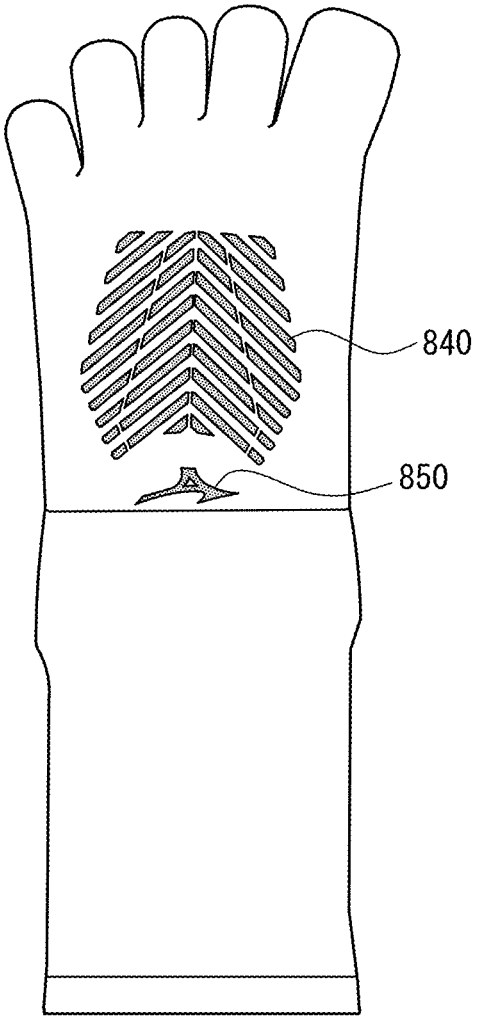
FIG. 13 is a schematic diagram showing the exterior side of a sports sock (for a left foot) used in Comparative Example 1 that is laid out flat, as viewed from an instep side.

A Zeroglide Short Sock (five-toed type) manufactured by Mizuno Corporation was used. As shown in FIGS. 12 and 13, the Zeroglide Short Sock includes anti-slip portions 810 disposed on the exterior side of the entire region covering the thenar, the hypothenar, and a portion therebetween on the sole of a forefoot of the sock main body such that the longitudinal direction extends obliquely downward, a plurality of anti-slip portions 820 disposed on the exterior side of the sole of the toe such that the longitudinal direction extends obliquely downward, a plurality of anti-slip portions 830 disposed on the exterior side of the sole of the rear foot such that the longitudinal direction extends obliquely upward, anti-slip portions 840 disposed on the exterior side of the forefoot on the instep side such that the longitudinal direction extends obliquely downward, and one anisotropic anti-slip portion 850 disposed at the center on the exterior side of a region covering the malleolus medialis, the malleolus lateralis, and a portion therebetween on the instep side.

Four healthy male subjects wearing the socks of Example 1 or Comparative Example 1 performed a 45° turning motion (turning motion for changing the traveling direction by 45°) five times and a 180° turning motion (turning motion for changing the traveling direction by 180°) five times. The shifting of the foot inside a spiked shoe during the 45° and 180° turning motions was measured as follows. Table 1 below shows the results.

(Shifting of Foot)

Figure 11:
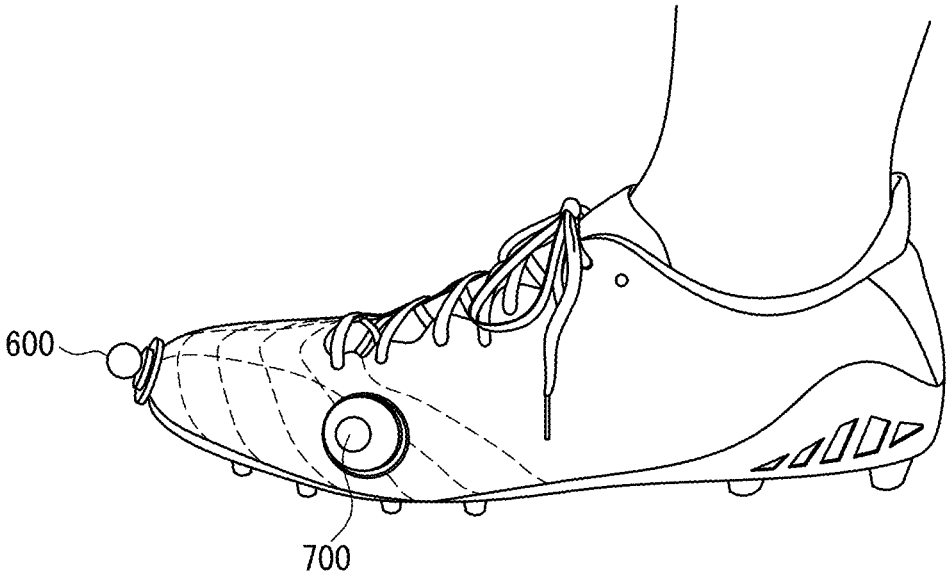
FIG. 11 is a schematic diagram showing the positions of markers attached to a spiked shoe when shifting of a foot in a shoe is measured.

As shown in FIG. 11, a marker 600 following the spiked shoe was attached to the toe of the spiked shoe, and a marker 700 was attached to the sock through a hole in the outer portion of the spiked shoe corresponding to the MP joint region of the forefoot.

The shifting of a foot was calculated as a difference between the minimum value and the maximum value of the distance between the marker 600 and the marker 700 in the grounding section.

A change in the distance between the marker 600 and the marker 700 during the 45° turning motion in football was measured. The measurement was conducted five times for each subject, and the calculated average value of the five measurement values was defined as the shifting of a foot during the 45° turning motion.

A change in the distance between the marker 600 and the marker 700 after the 180° turning motion in football was measured. The measurement was conducted five times, and the calculated average value of the five measurement values was defined as the shifting of a foot during the 180° turning motion.

TABLE 1

| | Shifting of foot (mm) | | | |
|---|---|---|---|---|
| | 45° turning motion | | 180° turning motion | |
| | Ex. 1 | Comp. Ex. 1 | Ex. 1 | Comp. Ex. 1 |
| Subject 1 | 2.8 | 5.2 | 3.2 | 3.8 |
| Subject 2 | 2.1 | 2.5 | 1.6 | 3.1 |
| Subject 3 | 3.6 | 3.8 | 4.7 | 4.1 |
| Subject 4 | 5.4 | 5.4 | 4.0 | 6.2 |
| Average | 3.5 | 4.2 | 3.4 | 4.3 |

As can be seen from the results in Table 1 above, when the sock of Example 1 was worn, the shifting of the foot inside the spiked shoe was suppressed during turning motions in sports, specifically during both the 45° and the 180° turning motions, compared to when the sock of Comparative Example 1 was worn.

The socks of the present invention are suitable for sports e.g. football, badminton, and tennis. In addition, the socks of the present invention can be used as regular socks.

The embodiments described above should be construed as merely examples of the present invention in all respects, and are not limiting. Those skilled in the art to which the present invention pertains can consider the contents of the teaching above to construct various embodiments that employ the principle of the present invention without departing the spirit and the essential characteristics of the present invention even though such embodiments are not explicitly described.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A sports sock comprising:

a sock main body; and an anti-slip portion disposed on an exterior side of the sock main body, wherein the anti-slip portion comprises an anisotropic first anti-slip portion disposed on the exterior side of a region of the main body corresponding to a thenar, a hypothenar, and a portion therebetween on a sole of a forefoot when the sock is worn, and the first anti-slip portion comprises:

a plurality of first inner anti-slip portions arranged in a radial fan-shaped manner, each first inner anti-slip portion being disposed on the exterior side of the sock main body and having a first end located at a common starting point on the sock main body such that the plurality of first inner anti-slip portions originate radially from the common starting point, a longitudinal direction of each of the first inner anti-slip portions extending inward toward an inner side of the sock from the common starting point, the common starting point being located in a region of the sock main body corresponding to a second metatarsal bone, a third metatarsal bone, and a fourth metatarsal bone of a foot when the sock is worn; and a plurality of first outer anti-slip portions arranged in a radial fan-shaped manner, each first outer anti-slip portion being disposed on the exterior side of the sock main body and having a first end located at the common starting point such that the plurality of first outer anti-slip portions originate radially from the common starting point, a longitudinal direction of each of the first outer anti-slip portions extending outward toward an outer side of the sock from the common starting point, wherein, when each of the first inner anti-slip portions is divided into two or three sections using virtual lines at regular intervals along the longitudinal direction, a surface area of the anti-slip portion within each section increases in a direction away from the common starting point toward the inner side of the sock, and when each of the first outer anti-slip portions is divided into two or three sections using virtual lines at regular intervals along the longitudinal direction, a surface area of the anti-slip portion within each section increases in a direction away from the common starting point toward the outer side of the sock.

2. The sports sock according to claim 1, wherein the anti-slip portion is made of resin, when each of the first inner anti-slip portions is divided into two or three sections using virtual lines at regular intervals along the longitudinal direction, an area of the resin in the section that is the closest to an inner end side is larger than an area of the resin in the section that is the closest to the common starting point, and when each of the first outer anti-slip portions is divided into two or three sections using virtual lines at regular intervals along the longitudinal direction, an area of the resin in the section that is the closest to an outer end side is larger than an area of the resin in the section that is the closest to the common starting point.

3. The sports sock according to claim 1, wherein the common starting point is located in a sub-region corresponding to a diaphysis of the third metatarsal bone when the sock is worn.

4. The sport sock according to claim 1, wherein the first inner anti-slip portions comprise:

one or more first inner lower anti-slip portions, the longitudinal direction of each of the first inner lower anti-slip portions extending obliquely inward and downward from the common starting point; and one or more first inner upper anti-slip portions, the longitudinal direction of each of the first inner upper anti-slip portions extending obliquely inward and upward from the common starting point, and the first outer anti-slip portions comprise one or more first outer lower anti-slip portions, the longitudinal direction of each of the first outer lower anti-slip portions extending obliquely outward and downward from the common starting point.

5. The sports sock according to claim 1, wherein the anti-slip portion further comprises a plurality of anisotropic toe anti-slip portions disposed on the exterior side of the sock main body in a region corresponding to a sole of a toe when the sock is worn, and a longitudinal direction of each of the toe anti-slip portions extends in a foot length direction.

6. The sports sock according to claim 1, wherein the anti-slip portion further comprises a plurality of anisotropic rear-foot anti-slip portions disposed on the exterior side of the sock main body in a region corresponding to a sole of a rear foot when the sock is worn, and a longitudinal direction of each of the rear-foot anti-slip portions extends in a foot length direction.

7. The sports sock according to claim 1, wherein the anti-slip portion further comprises one or more anisotropic second anti-slip portions disposed at a center on the exterior side of the sock main body in a region corresponding to a malleolus medialis, a malleolus lateralis, and a portion therebetween on an instep side when the sock is worn, and a longitudinal direction of each of the second anti-slip portions extends in a foot width direction.

8. The sports sock according to claim 1, having a height such that the sports sock extends to an area comprising an above-the ankle region and a below-the knee region, wherein the anti-slip portion comprises a heel anti-slip portion disposed on the exterior side of the sock main body in a region corresponding to a heel and extending toward to an upper end of a leg when the sock is worn.

9. The sports sock according to claim 1, wherein the sports sock is a five-toed type, including five separate toe sections respectively configured to receive individual toes of a wearer.

* * * * *